United States Patent [19]

Hütter et al.

[11] Patent Number: 4,989,988

[45] Date of Patent: Feb. 5, 1991

[54] APPARATUS FOR MIXING MEDIA CAPABLE TO FLOW

[75] Inventors: Karl Hütter, Graz; Heinz Lackner, Kindberg; Rolf Marr, Graz, all of Austria

[73] Assignee: Kenematica GmbH, Littau, Switzerland

[21] Appl. No.: 218,306

[22] Filed: Jul. 13, 1988

[30] Foreign Application Priority Data

Jul. 13, 1987 [AT] Austria ..... 109713

[51] Int. Cl.[5] ..... B01F 15/02

[52] U.S. Cl. ..... 366/150; 366/167; 366/176; 366/341

[58] Field of Search ..... 366/341, 337, 340, 150, 366/167, 176

[56] References Cited

U.S. PATENT DOCUMENTS

| | | | |
|---|---|---|---|
| 1,140,548 | 5/1915 | Vogelsang | 366/163 |
| 2,656,648 | 10/1953 | Friedmann | 366/163 X |
| 3,788,557 | 1/1974 | Breunsbach | 366/167 |
| 3,912,236 | 10/1975 | Zipperer et al. | 366/164 |
| 4,026,817 | 5/1977 | Ciuti et al. . | |
| 4,127,332 | 11/1978 | Thiruvengadam et al. | 366/176 X |
| 4,416,610 | 11/1983 | Gallagher, Jr. . | |
| 4,660,986 | 4/1987 | Leschonski et al. | 366/176 X |

FOREIGN PATENT DOCUMENTS

| | | | |
|---|---|---|---|
| 329012 | 4/1976 | Austria . | |
| 1557212 | 4/1970 | Fed. Rep. of Germany . | |
| 8602740 | 5/1987 | Netherlands | 366/341 |
| 1326326 | 7/1987 | U.S.S.R. | 366/341 |

*Primary Examiner*—Frankie L. Stinson

*Attorney, Agent, or Firm*—Marks Murase & White

[57] ABSTRACT

An apparatus for fine-mixing, dispersing, and emulsifying media capable to flow, such as gases or fluids, comprising an injection nozzle for injecting the pre-mixed media and a hollow body with a bore, disposed mirror-inverted and at a small distance thereto, the outlet end of said nozzle and inlet end of said hollow body, seen in the direction of flow, being a part of an annular gap working as pre-emulsifying chamber. For intensifying the mixing and effecting a pre-emulsification, the hollow body with the bore is sharp-edged. The apparatus further comprises a following homogenizing chamber having at its internal walls means for enhancing the turbulence of the mixture.

If no pre-mixed media are used, it is also possible to provide for one or more channels, disposed perpendicularly to the injection nozzle and reaching into said annular gap for injecting a second medium or further media.

The small, sharp-edged annular gap and the means for enhancing the turbulence of the mixture in the homogenizing chamber provide for a very good and stable emulsion needing less energy than known apparatus.

32 Claims, 4 Drawing Sheets

APPARATUS FOR MIXING MEDIA CAPABLE TO FLOW

BACKGROUND OF THE INVENTION

The present invention relates to an apparatus for mixing, dispersing, and emulsifying media capable to flow, for example gases or fluids, in particular for the production of emulsions. Different methods and apparatus are known for dispersing and emulsifying media capable to flow, such as rotating systems with a rotor and a stator with teeth, whereby the media are sheared and dispersed or emulsified. Another group comprises high pressure systems, up to a pressure of $5\times10^7$Pa, where the fluids are ejected at high pressure and therefore high velocity from a nozzle. A third, low pressure—up to $2\times10^6$Pa—system is known for example from the Austrian Patent No. 329,012, comprising a mixing chamber with a torus arranged around the inlet nozzle, said torus being conical on the inlet side, and further comprising at the opposite mixing chamber wall a corresponding, parallely arranged conical surface for building an annular gap for obtaining a cavitation of the medium to be mixed. The inlet pipe and the mixing chamber walls comprise twist generating elements.

However, it appeared that this apparatus, although an improvement over the prior art existing at that time could not treat all media in a satifactorily manner.

SUMMARY OF THE INVENTION

It is therefore an object of the present invention to provide an apparatus for treating media capable to flow with an improved mixing ability and increased stability, in particular for difficult to emulgate media, such as for example a small amount of water in much oil. To solve this problem a first embodiment of an apparatus of the invention comprises an injection nozzle for injecting premixed media and a hollow body with a bore, disposed mirror-inverted and at a small distance thereto, the outlet end of said nozzle and inlet end of said hollow body, seen in the direction of flow, being a part of an annular gap working as pre-emulsifying chamber, said inlet end of the hollow body with the bore being sharp-edged, and further comprising a following homogenizing chamber having at its internal walls means for enhancing the turbulence of the mixture.

The apparatus of a second embodiment comprises further at least one injection channel disposed perpendicularly to the injection nozzle for the continuous phase, said injection channel reaching into the annular gap for injecting the discontinous phase.

BRIEF DESCRIPTION OF THE DRAWINGS

The invention will be described further by way of examples with reference to the accompanying drawings, in which.

DESCRIPTION OF THE PREFERRED EMBODIMENTS

Figure 1:
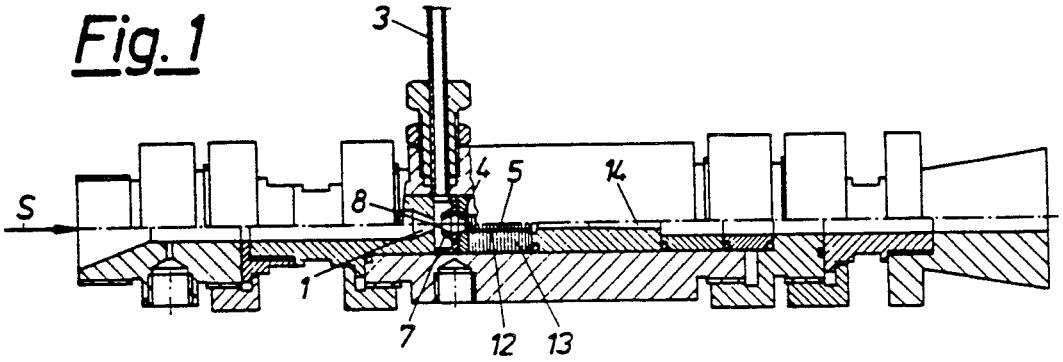
FIG. 1 shows in a partial longitudinal section the main parts of the apparatus according to the invention.
Figure 2:
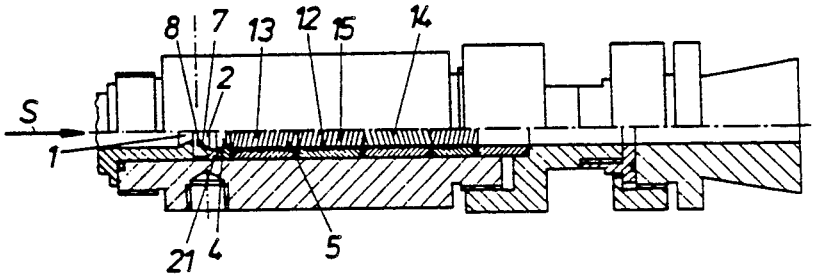
FIGS. 2 and 3 show each a modification of the embodiment of FIG. 1.
Figure 3:
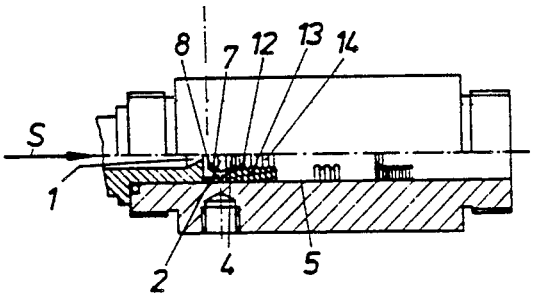
Figure 4:
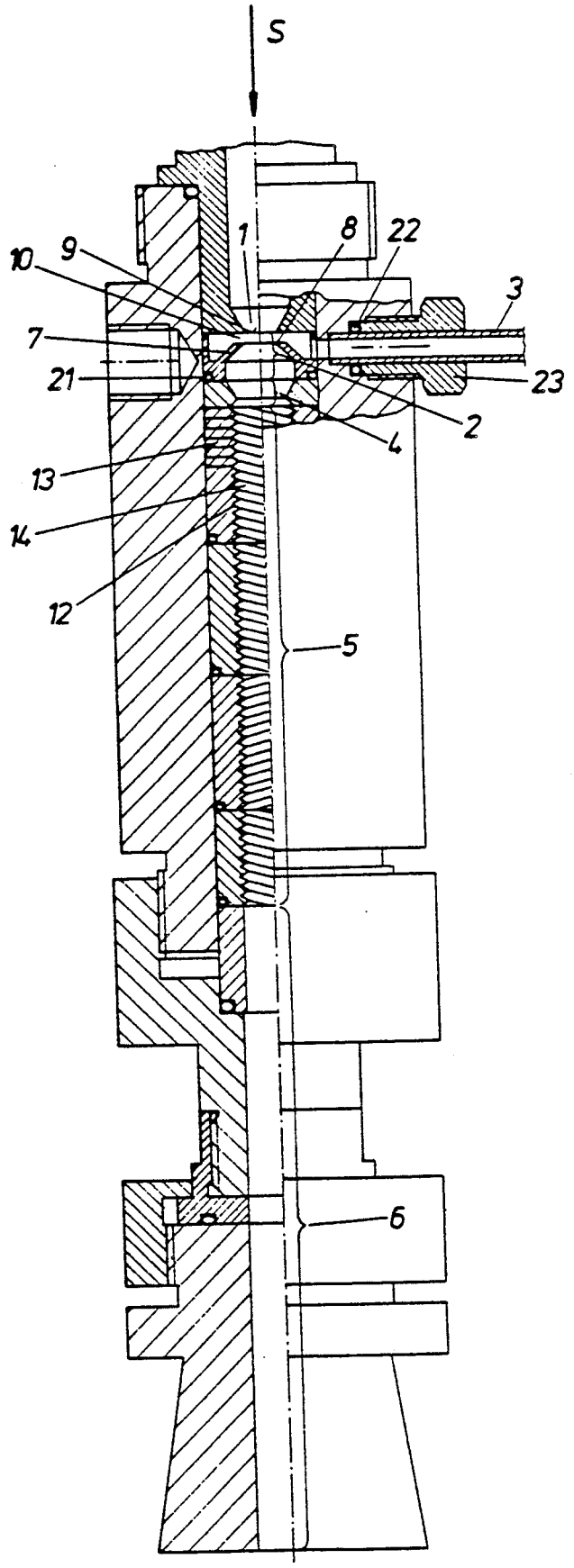
FIG. 4 shows in an enlarged scale the slightly modified apparatus of FIG. 1.
Figure 5:
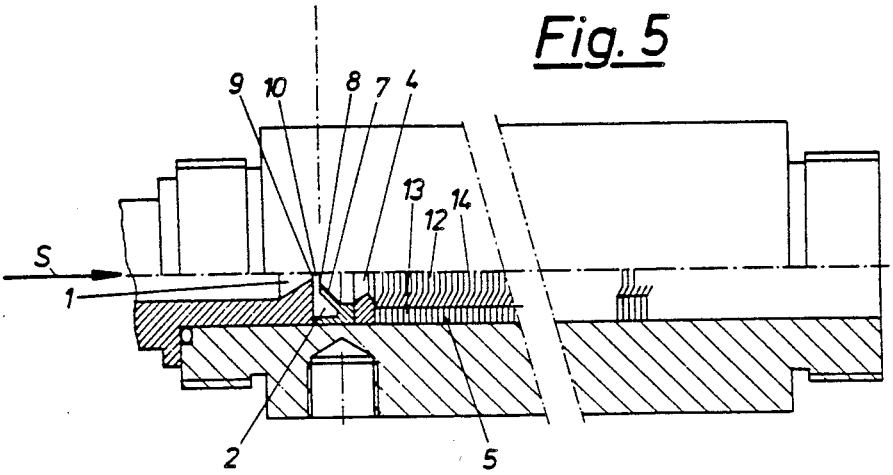
FIG. 5 shows a modification of FIG. 4.
Figure 6:
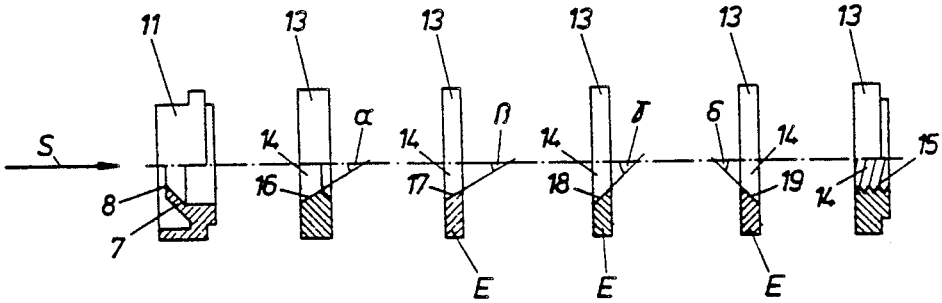
FIG. 6 shows in an exploded view parts of the apparatus according to FIG. 1, FIGS. 7–10 show several embodiments of the pre-emulsifying chamber.
Figure 7:
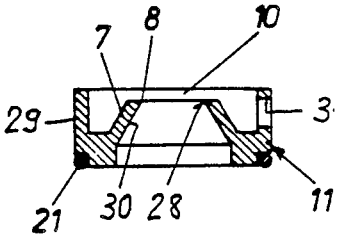
Figure 8:
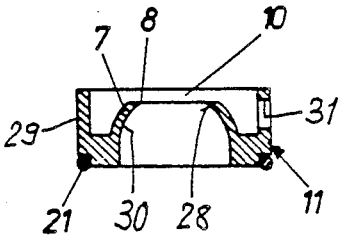
Figure 9:
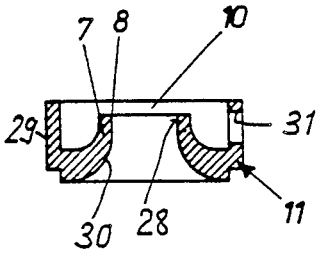

The main parts of the apparatus of a first preferred embodiment of the invention for emulsifying pre-mixed media are best shown in the FIGS. 4 and 6, disregarding the injection channel 3. According to it the apparatus comprises an injection nozzle 1, opposite and in a small distance to it, a hollow body in the form of a truncated cone 7, disposed in a mirror-inverted manner, and a homogenizing chamber 5, having at its internal surface 12 swirling means 13 (FIG. 1).

Between the end 9 of the conically shaped injection nozzle 1 and the front of the hollow truncated cone 7 a pre-emulsifying chamber 2 is build, in the form of a small annular gap 10. The front of the hollow truncated cone 7, looking toward the injection nozzle, is formed as sharp edge 8. The hollow part 4 of the body 7, the chamber 5, and the piece 6 form the homogenizer; part 4 in the hollow body 7 being the inlet, and piece 6 (FIG. 4) the outlet of it.

Figure 10:
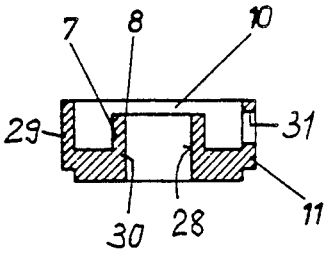

The FIGS. 1–10 show different variations of the hollow body 7. The FIGS. 1–6, and 7 show a truncated cone as hollow body, FIGS. 8 and 9 with concave and convex sides. FIG. 10 shows a cylindrical hollow body. It follows in particular from the FIGS. 7–10 that the hollow body 7 is contained in an insertion piece 11 and that the annular gap 10 is formed around the bore 28 of body 7 thus as to obtain an outer wall 29 and an inner wall 30, wherein the outer wall 29 is higher than inner wall 30. The function of aperture 31, also shown in those figures, will be explained later on. At its outlet side the insertion piece 11 contains a recess for receiving an O-ring 21.

It follows also that the said sharp-edged front part 8 is the inlet front end of the inner wall, formed around the bore 28.

The aim of each mixing, emulsifying or dispersing apparatus is to achieve a fine and homogen mixture of the components. In the case of media capable to flow, like fluids, it is important to disrupt any film formed by the media, for instance by water and oil respectively. The sharp-edged front of the hollow body, the annular gap between said body and the injection nozzle are some of the very effective means to disrupt any film and to achieve pre-emulsification of injected pre-mixed media.

Emulsions are systems with at least two phases, which are not or only to a small extent soluble one in another. It is distinguished between a continuous phase, in which the other, the discontinuous one is distributed in the form of small droplets, forming two groups. There are the oil-in-water and the water-in-oil emulsions. Every high polar, hydrophile fluid falls into the category that water is in, whereas the hydrophobic, non-polar fluids are treated similar to oil. If oil and water are brought together and treated very strongly mechanically, one is dispersed into the other and a multitude of droplets are formed. If the system stays at rest, differences in the density lead to the separation of the phases. By admixing substances for lowering the surface tension, the coalescense is stopped. The invention allows a substantial improvement of the problem of manufacturing stable mixtures, in particular emulsions.

A further important item of the invention is the homogenizing chamber 5, to which the mixture arrives through the short inlet piece 4 and the cavity of the hollow body 7. The internal surface 12 of chamber 5 is rough, for enhancing and maintaining the swirling effect of the annular gap 10 and sharp edge 8, hindering a film to form. The homogenizing chamber 5 can have any shape, such as a cylindrical, elliptical, conical or rectangular section. According to a first embodiment, the roughness of the internal surface 12 can be effectuated by inserted small plates 13, with one or several bores 14 each, said bores having different edges, sharp or not, or being in the form of a sharp-edged thread 15 (FIG. 6), or the like other edged or rough means. FIG. 6 shows from the left to the right the hollow body 7 with the sharp edge 8 at the bore, contained in the insertion piece 11, a first plate 13 with a bore 14 having an internal edge 16, a second plate 13 with bore 14 having another internal edge 17, a third and a fourth plate 13 with a bore 14 having different edges 18 and 19, the angle $\alpha$-$\delta$ thereof with respect to the axis of the flow direction S increasing in the direction of flow S, preferably from an acute to an obstuse angle. The last plate shows an internal thread 15.

The outlet piece 6 can have, like the homogenizing chamber, a cylindrical, elliptical, conical or rectangular section. The substantial parameters for the flow and the degree of quality of the emulsion are mainly the homogenizing pressure, the volume flow, the density of the media to be mixed as well as their viscosity and the geometries of the nozzle, of the pre-emulsifying chamber, of the homogenizing chamber, and of the outlet piece; and at least of the condition of flow.

Figure 11:
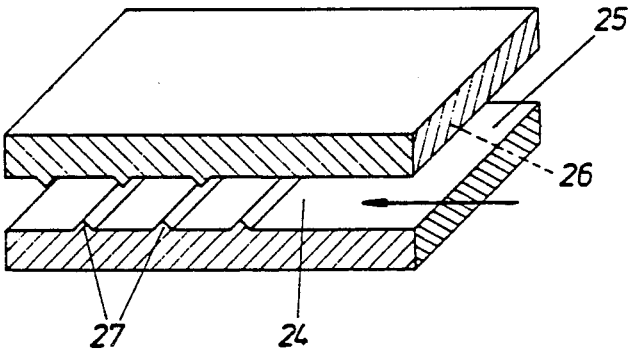
FIG. 11 shows schematically a parallelepipedic homogenizing chamber.

FIG. 11 shows a parallelepipedic homogenizing chamber 24 with lateral walls 25, 26 with great surfaces arranged parallel to each other, which are provided with ribs 27 instead of the plates 13, for enhancing the turbulence of the flow of the pre-emulsion. The ribs are disposed transversally to the direction of the flow, indicated by an arrow.

As mentioned before, the media to be mixed, homogenized, emulsified or dispersed can be pre-mixed and injected by the injection nozzle 1, from where it impinges on the sharp edge 8 of the hollow body and into the small annular gap, resulting in a pre-emulsification which is completed in the homogenizing chamber 5.

There exist media where pre-mixing is not desired or feasible. One of such system is a water-in-oil system where the water is injected separatedly. In the preferred second embodiment of the invention the supporting medium, for example oil, is injected by injection nozzle 1. Thereby it is possible to use a not shown inlet pipe comprising twist generating means according to the Austrian Patent No. 329,012. The second medium, for example water, is injected by an injection channel 3, as best shown in FIG. 4. Injection channel 3 is disposed perpendicularly to injection nozzle 1 and reaches via aperture 31 (FIGS. 7–10) into the annular gap 10, where the water impinges on the swirled oil. In this case, the annular gap functions as pre-mixing and pre-emulsifying chamber.

The water can contain solid particles, and instead of water acids or caustic solutions can be treated.

The injection channel 3 is constructed as insertion part 23, comprising a O-ring 22 for sealing it. In the pre-mixing chamber 10 the second medium, the discontinuous phase, water, is admixed perpendicularly to the main medium, the continuous phase, oil, ring-like around the thin-walled hollow body 7. The sharp edge 8 is very important in this connection, with which the film building up at the innner wall of the hollow body is torn apart, causing a good pre-mixing and pre-emulsifying.

In particular, the dispersing or comminution of the medium or media is achieved such that one phase is injected under pressure by an injection nozzle into the pre-emulsifying chamber 2 into which the further phase, according to the construction, is either sucked in by the injection action or pumped in. In this pre-emulsifying chamber 2, which is constructed as annular gap 10 with the sharp edge 8, the inner phase is pre-comminuted for the following homogenizing. The pre-emulsified mixture is subsequently treated as in the first example.

The apparatus according to the invention is particularly valuable for the production of stable emulsions. Instead of oil, any fat substance can be treated, and also aqueous phases. The media can contain pre-distributed solid substances, for example catalysators.

It is also possible to provide the apparatus with more than one injection channel 3, necessitating to provide for an aperture in the annular gap for each injection channel.

The apparatus according to the invention can be qualified as a static low pressure homogenizator, that is, besides the pump(s) no moveable parts are required, and it is possible to work with relatively thin walls. Low pressure results also in low energy consumption. The medium injected through the main injection nozzle 1 needs a pressure of about 1 to $20\times10^5$Pa (1 to 20 Bar), preferably $10\times10^5$Pa.

By maintaining determined values of the parameters it is possible to obtain very good and stable emulsions, and a very good thoroughly mix by mechanical-physical treatment, so that the addition of chemical emulsifying agents can be substantially omitted. Thus, the emulsions can be preserved substantially in its chemical structure. It is further possible, by variating the geometries of the four main elements, namely injector nozzle, pre-emulsifying chamber (annular gap), homogenizing chamber and outlet piece, to exclude nearly totally cavitation and thus the addition of impurities.

We claim:

1. An emulsifying and mixing apparatus comprising, a housing, an injection nozzle positioned at one side of said housing for injecting a premixed media, a hollow body positioned opposite to said injection nozzle in said housing and separated from said injection nozzle by an annular gap, said hollow body having a sharp-edged inlet end for receiving premixed media injected into the annular gap by said injection nozzle and an outlet end for passing the media, and being disposed in a mirror-inverted manner, and a homogenizer adjoining said hollow body in said housing, said homogenizer having an inlet adjoining the outlet end of said hollow body for receiving the media from said hollow body, a homogenizing chamber for causing turbulence in the media through internal walls adapted to cause turbulence in the media and an outlet for passing the media.

2. An apparatus according to claim 1, wherein said injection nozzle has an outlet end which is conical in shape.

3. An apparatus according to claim 2, wherein said hollow body is a truncated cone having internal and external walls which are substantially parallel to one another.

4. An apparatus according to claim 2, wherein said hollow body is a hollow truncated cone having internal walls curved toward a longitudinal central axis through said hollow body.

5. An apparatus according to claim 2, wherein said hollow body is a hollow truncated cone having internal walls curved away from a longitudinal central axis through said hollow body.

6. An apparatus according to claim 2, wherein said hollow body is a hollow cylinder.

7. An apparatus according to claim 1, further comprising an insertion piece having an outer wall which surrounds said hollow body, the outer wall being taller than said hollow body.

8. An apparatus according to claim 1, wherein said homogenizing chamber has a cylindrical shape.

9. An apparatus according to claim 1, wherein said homogenizing chamber has an elliptical shape.

10. An apparatus according to claim 1, wherein said homogenizing chamber has a conical shape.

11. An apparatus according to claim 1, wherein said homogenizing chamber has a rectangular shape.

12. An apparatus according to any one of claims 8–11, wherein the internal walls of said homogenizing chamber comprise a plurality of plates acting to cause turbulence in said homogenizing chamber, each plate having at least one bore with at least one edge.

13. An apparatus according to claim 12, wherein the media flows in a particular direction in said homogenizer and each edge of each bore forms an obtuse angle with respect to the direction of flow.

14. An apparatus according to claim 13, wherein the media flows in a particular direction in said homogenizer and each edge of each bore forms an acute angle with respect to the direction of flow.

15. An apparatus according to claim 13, wherein the bores of said plates are connected in a thread-like manner.

16. An emulsifying and mixing apparatus comprising, a housing, an injection nozzle positioned at one portion of said housing for injecting a continuous phase media.

a hollow body positioned opposite to said injection nozzle in said housing and separated from said injection nozzle by an annular gap, said hollow body having a sharp-edged inlet end, an outlet end and being disposed in a mirror-inverted manner, at least one injection channel for injecting a discontinous phase media into the annular gap, whereby the continuous phase media is injected into the annular gap by said nozzle and the discontinous phase media is injected into the annular gap through said injection channel, both media entering said hollow body through the sharp-edged inlet end and passing out of said hollow body through the outlet end, and a homogenizer adjoining said hollow body in said housing, said homogenizer having an inlet adjoining the outlet end of said hollow body for receiving the media from said hollow body, a homogenizing chamber for causing turbulence in the media through internal walls adapted to cause turbulence in the media and an outlet for passing the media.

17. An apparatus according to claim 16, wherein said injection nozzle has an outlet end which is conical in shape.

18. An apparatus according to claim 17, wherein said hollow body is a truncated cone having internal and external walls which are substantially parallel to one another.

19. An apparatus according to claim 17, wherein said hollow body is a hollow truncated cone having internal walls curved toward a longitudinal central axis through said hollow body.

20. An apparatus according to claim 17, wherein said hollow body is a hollow truncated cone having internal walls curved away from a longitudinal central axis through said hollow body.

21. An apparatus according to claim 17, wherein said hollow body is a hollow cylinder.

22. An apparatus according to claim 16, further comprising an insertion piece having an outer wall which surrounds said hollow body, the outer wall being taller than said hollow body.

23. An apparatus according claim 16, wherein said homogenizing chamber has a cylindrical shape.

24. An apparatus according to claim 16, wherein said homogenizing chamber has an elliptical shape.

25. An apparatus according to claim 16, wherein said homogenizing chamber has a conical shape.

26. An apparatus according to claim 16, wherein said homogenizing chamber has a rectangular shape.

27. An apparatus according to any one of claims 23–26, wherein the internal walls of said homogenizing chamber comprise a plurality of plates acting to cause turbulence in said homogenizing chamber, each plate having at least one bore with at least one edge.

28. An apparatus according to claim 27, wherein the media flows in a particular direction in said homogenizer and each edge of each bore forms an obtuse angle with respect to the direction of flow.

29. An apparatus according to claim 27, wherein the media flows in a particular direction in said homogenizer and each edge of each bore forms an acute angle with respect to the direction of flow.

30. An apparatus according to claim 27, wherein the bores of said plates are connected in a thread-like manner.

31. An emulsifying or mixing apparatus comprising, a housing, an injection nozzle positioned at one portion of the housing for injecting a premixed media, a hollow body positioned opposite to said injection nozzle in said housing and separated from said injection nozzle by an annular gap, said hollow body having a sharp-edged inlet end for receiving premixed media injected into the annular gap by said injection nozzle and an outlet end for passing the media, and being disposed in a mirror inverted manner, and a homogenizer adjoining said hollow body in said housing, said homogenizer having an inlet adjoining the outlet end of said hollow body for receiving the media from said hollow body, the media having a direction of flow in said homogenizer, an outlet for passing the media, and a homogenizing chamber having a geometrical shape for causing turbulence in the media through internal walls adapted to cause turbulence in the media, the internal walls comprising a plurality of plates, each plate having at least one bore with at least one edge, each edge of each bore forming an angle with respect to the direction of flow of the media.

32. An emulsifying or mixing apparatus comprising, a housing, an injection nozzle positioned at one portion of the housing for injecting a continuous phase media, a hollow body positioned opposite to said injection nozzle in said housing and separated from said injection nozzle by an annular gap, said hollow body having a sharp-edged inlet end, an outlet end and being disposed in a mirror-inverted manner, at least one injection channel for injecting a discontinous phase media into the annular gap, whereby the continuous phase media is injected into the annular gap by said nozzle and the discontinous phase media is injected into the annular gap through said injection channel, both media entering said hollow body through the sharp-edged inlet end and passing out of said hollow body through the outlet end, and a homogenizer adjoining said hollow body in said housing, said homogenizer having an inlet adjoining the outlet end of said hollow body for receiving the media from said hollow body, the media having a direction of flow in said homogenizer, an outlet for passing the media, and a homogenizing chamber having a geometrical shape for causing turbulence in the media through internal walls adapted to cause turbulence in the media, the internal walls comprising aplurality of plates, each plate having at least one bore with at least one edge, each edge of each bore forming an angle with respect to the direction of flow of the media.

* * * * *

UNITED STATES PATENT AND TRADEMARK OFFICE

CERTIFICATE OF CORRECTION

PATENT NO. : 4,989,988

DATED : February 5, 1991

INVENTOR(S) : HUTTER et al.

It is certified that error appears in the above—identified patent and that said Letters Patent is hereby corrected as shown below:

On the title page:

Item [73] Assignee: "Kenematica GmbH", should be -- Kinematica GmbH --.

Signed and Sealed this

Thirtieth Day of June, 1992

*Attest:*

DOUGLAS B. COMER

*Attesting Officer*

*Acting Commissioner of Patents and Trademarks*